United States Patent [19]

Wellings

[11] 4,230,013

[45] Oct. 28, 1980

[54] ELECTRO-ACOUSTIC TRANSDUCER

[76] Inventor: Frederick L. Wellings, 107 Park St., London W1Y 3TA, United Kingdom

[21] Appl. No.: 22,383

[22] Filed: Mar. 21, 1979

[30] Foreign Application Priority Data

May 15, 1978 [GB] United Kingdom ..... 19609/78

[51] Int. Cl.[3] ..... G10H 3/12

[52] U.S. Cl. ..... 84/1.14; 361/283; 361/290

[58] Field of Search ..... 84/1.04, 1.06, 1.14, 84/1.16, DIG. 19; 179/106, 111R; 361/283, 290

[56] References Cited

U.S. PATENT DOCUMENTS

| | | | |
|---|---|---|---|
| 2,834,243 | 5/1958 | Miessner | 84/1.14 |
| 3,267,196 | 8/1966 | Welsh et al. | 84/DIG. 19 |
| 3,510,564 | 5/1970 | Wetsell et al. | 84/1.04 |
| 3,538,232 | 11/1970 | Bachtig et al. | 84/1.14 |
| 4,002,994 | 1/1977 | Fender | 84/1.14 X |

*Primary Examiner*—Stanley J. Witkowski

*Attorney, Agent, or Firm*—Pollock, Vande Sande & Priddy

[57] ABSTRACT

An electro-acoustic transducer for a musical instrument, for producing electrical signals indicative of sound produced by playing of the instrument. The transducer comprises a housing of plastic material containing a capacitor microphone arrangement which comprises a first metal foil electrode within a sheath of metal foil which defines a second electrode. A dielectric separates the two electrodes. The capacitor microphone arrangement is sandwiched between a relatively rigid wall of the housing and a relatively flexible body of plastic material within the housing. The housing is adapted to be mounted in intimate contact with a surface of the instrument which vibrates in accordance with sound produced by playing of the instrument, so that the vibrations are transmitted to the electrodes. A constant electrical potential difference is applied to the electrodes and oscillatory voltages produced by the vibration of the electrodes are amplified by an amplifier to produce an electrical signal indicative of the music produced by the instrument.

20 Claims, 7 Drawing Figures

FIG.1.
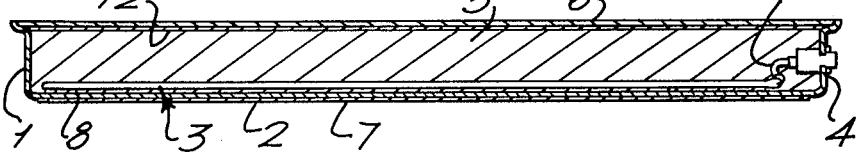
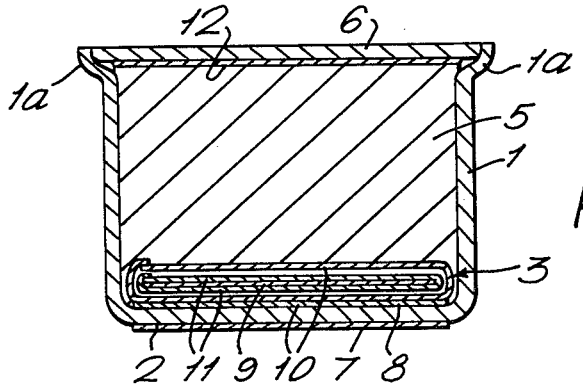
FIG.2.
FIG.3.
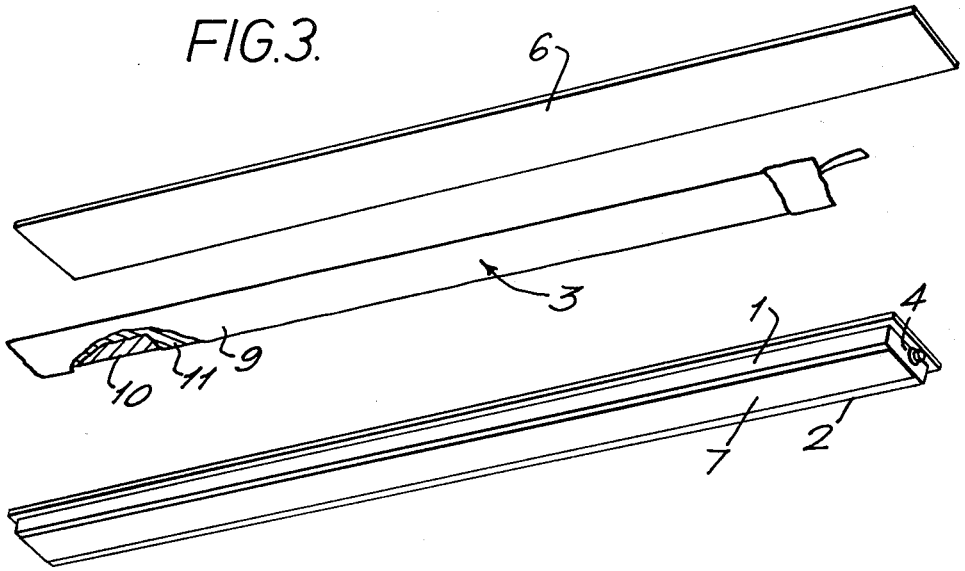

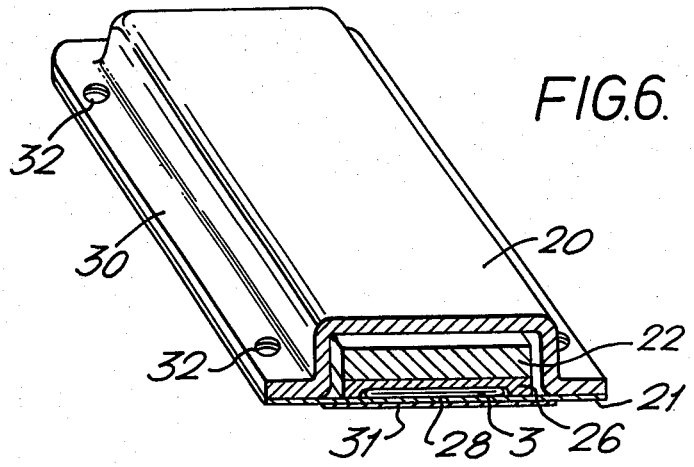
FIG.6.
FIG.7.
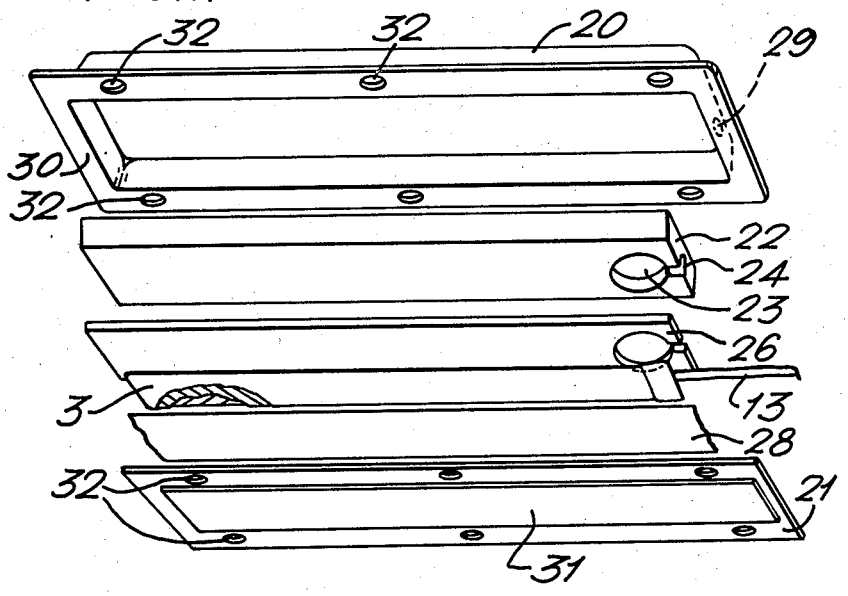

ELECTRO-ACOUSTIC TRANSDUCER

FIELD OF THE INVENTION

This invention relates to an electro-acoustic transducer for providing electrical signals indicative of sound produced by a musical instrument.

BACKGROUND TO THE INVENTION

When making a magnetic tape recording in a recording studio, of a band or orchestra including many different instruments, it is usual to provide respective microphones for the instruments or for groups of the instruments, and to record the electrical signals from the microphones separately on respective tracks of a multi-track magnetic tape. The microphones may be of any of the conventional types, capacitor microphones for example, each mounted to produce electrical signals in response to air vibrations produced by playing of the instrument to which the microphone is directed. After recording, the recorded signals from the different tracks are mixed and re-recorded onto typically a twin track magnetic tape to produce a master tape from which a stereo gramophone record can be made. The mixing of the signals permits a desired balance between the relative amplitudes of the instruments to be achieved. For the mixing to be effective, it is desirable that the signals recorded on the different tracks of the multi-track tape are each representative substantially only of one of the instruments or a predetermined group of instruments, but in practice this is difficult to achieve for certain instruments, particularly drums and also stringed instruments such as pianos. In the usually cramped conditions of a recording studio, a conventional microphone positioned to detect sound produced by a piano usually also detects sound produced by adjacent instruments; this degrades the recording unless other measures are taken.

A similar difficulty arises when electrical amplifiers and loudspeakers are used to amplify a live performance of a band in a concert hall. Usually separate microphones are used for different instruments, and the signals therefrom are mixed selectively before being amplified and fed to loudspeakers in the hall. However, for certain instruments, the microphones tend to detect sound not only from the instrument to which they are directed, but also from adjacent instruments.

This problem is particularly serious for a piano, and a conventional microphone directed at a piano will respond not only to the sound from the piano but also to sound from adjacent instruments, with the result that it is often not possible to give the sound from the piano a desired prominence in the sound emanating from the loudspeakers.

In order to overcome these problems for a piano, a pick-up device has been devised which consists of a support member extending transversely of the strings of the piano, on which is mounted a series of magnetic pick-ups which produce electrical signals in response to oscillations of the strings when the piano keys are struck. The device is however relatively expensive due to the number of individual magnetic pick-ups required for the many strings of a piano. Also, the device requires a complicated adjustment prior to use because in order to obtain a uniform amplitude response for the different notes of the piano, the gains of the outputs from the numerous pick-ups need to be adjusted individually. Additionally, the pick-ups all need to be close to the strings in order to obtain a satisfactory response, which requires a delicate adjustment. Moreover, if the piano is moved, for example by being pushed on or off a stage, or by being transported in a truck between concert halls, the setting of the pick-up device becomes disturbed, and the time consuming and complicated adjustment often needs to be carried out after such moves of the instrument.

SUMMARY OF THE INVENTION

It is an object of the present invention to provide an electro-acoustic transducer which overcomes the aforesaid problems and difficulties of prior art microphones and pick-ups.

It is a more particular object of the present invention to provide a simpler and less expensive electro-acoustic transducer which will respond substantially only to the musical instrument to which it is attached.

It is another object of the invention to provide an electro-acoustic transducer which can be easily and simply installed on an instrument without the need for the complex adjustment procedure of the known pick-up device aforesaid.

In accordance with the present invention, I provide an electro-acoustic transducer which in use is attached to a musical instrument on a surface thereof which vibrates in accordance with sound produced by playing of the instrument, such that the vibration of the surface causes the transducer to produce electrical signals indicative of the sound produced by playing of the instrument. The transducer of the invention consists of a housing of plastic material in which is housed a capacitor microphone arrangement comprising two overlying electrodes between which is a layer of dielectric. In use, a substantially constant electrical potential difference is applied to the electrodes. The housing is arranged to be mounted in contact with the instrument surface such that the vibrations produced on playing of the instrument are transmitted to the electrodes such that they are displaced in accordance with the vibrations, thereby producing an oscillatory voltage between the electrodes indicative of the sound produced by playing of the instrument. The voltage developed across the electrodes is fed to a sensing circuit which includes an amplifier that amplifies the oscillatory voltage separately from the constant potential difference applied to the electrodes and hence the output of the amplifier is an electrical signal indicative of the sound produced by the instrument.

The transducer according to the present invention has the advantage that, because it is in use attached to a surface of the instrument and is responsive to the vibration of the surface, it responds substantially only to the instrument to which it is attached, and its output is not degraded by sound from adjacent instruments. Moreover, the transducer of the invention responds to the entire fundamental frequency range of most musical instruments, so that the complicated balancing adjustment of the prior art magnetic pick-up device is not required. Also, the installation of the transducer of the present invention is a simple matter; it can be stuck to the instrument with self-adhesive tape or can be screwed in position if a more permanent affixation is required. Accordingly, the transducer does not require complex readjustment each time the instrument is moved.

In a preferred embodiment of the invention, the capacitor microphone arrangement is sandwiched between a relatively flexible body of plastic material and a relatively rigid support member of plastic material for attachment to the instrument surface. It has been found that this preferred arrangement provides for improved transmission of the surface vibrations of the instrument to the electrodes.

A particularly preferred form of the capacitor microphone arrangement consists of a first electrode in the form of an elongate foil of electrically conductive material, a second electrode comprising an elongate flat sheath of electrically conductive foil within which the first electrode is received and a dielectric between the electrodes electrically insulating them from one another.

The housing preferably comprises an elongate box of plastic material having a lid, the capacitor microphone arrangement being sandwiched between a wall of the box or the lid, and a body of plastics material which is more flexible than the material of the box or lid.

Further features, objects and advantages of the present invention will become apparent from the following description of two embodiments thereof given by way of illustrative example with reference to the accompanying drawings.

BRIEF DESCRIPTION OF THE DRAWINGS

In the drawings:

FIG. 1 is a longitudinal sectional view of an electro-acoustic transducer in accordance with the present invention, FIG. 2 is an enlarged transverse sectional view of the transducer, FIG. 3 is a schematic, perspective exploded view of the transducer, FIG. 6 is a broken away perspective view of another embodiment of an electro-acoustic transducer in accordance with the present invention, and FIG. 7 is a schematic perspective exploded view of the transducer of FIG. 6.

DESCRIPTION OF PREFERRED EMBODIMENTS

Figure 4:
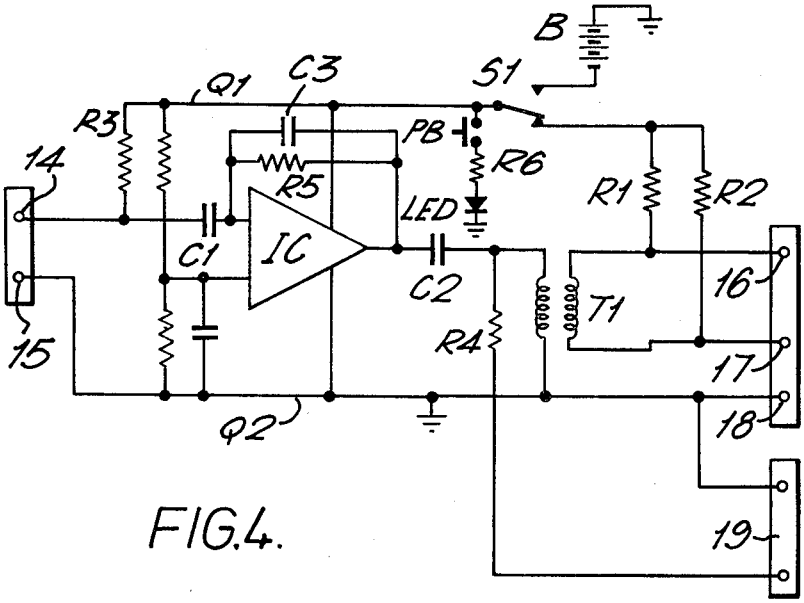
FIG. 4 is a schematic circuit diagram of an electrical sensing circuit for connection to the transducer.

The transducer shown in FIGS. 1 to 3 comprises an elongate box 1 open on one side and having a rectangular base 2, in which is received a capacitor microphone arrangement 3 connected to an output jack socket 4, the box 1 being filled with a cold curing polyurethane compound 5 and being closed by a lid 6. The capacitor microphone arrangement 3 is thus encapsulated within a housing of plastic material. In use, the base 2 of the transducer is mounted in intimate contact with a surface of a musical instrument, which surface resonates in accordance with the sound produced by playing of the instrument. A sensing circuit such as shown in FIG. 4, is connected to the capacitor microphone arrangement 3 through the jack socket 4, to provide electrical signals indicative of the sound produced by the musical instrument.

The structure of the transducer will now be described in detail with particular reference to FIG. 2 in which the various layers thereof are shown on an enlarged scale for purposes of clarity.

The box 1 is made of 0.002–0.003 inch thick high impact molded polystyrene and has attached thereto along the length of the underside of its base 2, a strip of double sided adhesive fabric tape 7 for attaching the transducer to a musical instrument. The capacitor microphone arrangement 3 includes a strip of double sided adhesive polyester tape 8, by which it is attached to the upper side of the base 2 along its length. The capacitor microphone arrangement 3 comprises a first central electrode 9 consisting of an elongate strip of aluminum foil received within a second electrode 10 which comprises an elongate sheath of flexible aluminum foil. The first electrode 9 is totally encapsulated with a dielectric 11 which may or may not be polarized; in this example, the dielectric 11 comprises a self-adhesive polyester tape attached to the electrode 9. A small air gap exists between the dielectric 11 and the second electrode.

The box 1 is filled with the cold curing polyurethane compound 5 above the capacitor microphone arrangement 3, the compound typically having a depth of $\frac{3}{8}''$. It will thus be appreciated that the capacitor microphone arrangement 3 is received between and in intimate contact with the relatively rigid supporting base of the box 1 and the relatively flexible plastic material 5. A strip of doubled sided self adhesive polyester tape 12 is attached on one side to the top of the compound 5, and on the other side to the lid 6. The lid 6 consists of polythene sheet and is glued at its periphery to a peripheral recess 1*a* formed in the box 1.

Referring now to FIG. 1, the jack socket 4 includes two output terminals (not shown) which are connected to the first and second electrodes 9, 10 (FIG. 2) by means of a length of coaxial cable 13 the shielded conductor of which is soldered to the first electrode and the shielding conductor of which is soldered to the second electrode. A jack plug (not shown) fits into the socket 4 and a length of coaxial cable connects the electrodes 9, 10 to inputs 14, 15, respectively, of the sensing circuit shown in FIG. 4. The circuit is arranged to apply a constant electrical potential difference between the electrodes 9, 10 of FIG. 2, and to sense and amplify oscillatory voltages produced between the electrodes by virtue of the microphone arrangement 3 responding to sound produced by the musical instrument.

The sensing circuit is housed in a metal box (not shown) which receives dry cell batteries B to drive the circuit. The batteries B establish an 18 volt rail voltage relative to ground between rails Q1, Q2. The circuit can also be driven from the external power source which is usually available in recording studios and public address systems that employ a mixer, namely the conventional 48 volt d.c. supply known in the art as the "phantom" power supply. The phantom supply, when available is fed to the circuit by a cannon plug which connects with terminals 16, 17, 18.

An output from the circuit is taken by means of a jack plug socket 19, or, if the phantom power supply is not being used, by means of a cannon plug connected to the terminals 16, 17, 18. The cannon plug output is balanced relative to ground.

A switch S1 selects power either from the phantom power supply through dropping resistors R1, R2, or from the batteries B, and a d.c. bias voltage is applied through a resistor R3 to the terminals 14, 15 so as to bias the electrodes 9, 10 of the capacitor microphone arrangement. As will be explained hereinafter, in use of the transducer, oscillatory voltages will be induced between the terminals 14, 15. The oscillatory voltages pass through a capacitor C1 which blocks the d.c. bias, to an input of an operational amplifier IC. The amplified output of the amplifier IC passes through a capacitor C2, and hence through a resistor R4 to the output jack 19, and through a transformer T1 to the cannon plug outlet. The transformer T1 makes the cannon plug output balanced relative to ground. The amplifier IC is provided with a feedback loop including a resistor R5 and a capacitor C3, which provides for a uniform frequency response.

The circuit also includes a battery test circuit comprising a push button PB, a LED and an associated resistor R6. If the batteries B are in good order, the LED will illuminate when the button PB is depressed. The test circuit can also be used, when the phantom power is connected, to check that the phantom power is reaching the circuit.

In use of the transducer, it is attached by means of the self adhesive tape 2, in intimate contact with a surface of a musical instrument which vibrates in accordance with the sound produced by playing the instrument. The vibrating surface causes oscillation of the electrodes 9, 10 and accordingly effects the spacing therebetween, thereby producing an oscillatory voltage between the inputs 14, 15 which is amplified by the amplifier IC. It has been found that the amplified signals produced at the outputs 17, 18, after further amplification and presentation to an appropriate loudspeaker, provide sound which accurately represents the sound of the instrument to which the transducer is attached.

Figure 5:
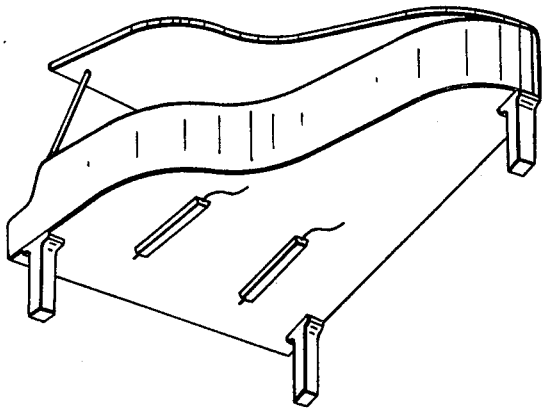
FIG. 5 illustrates two of the transducers installed on the underside of a grand piano.

It is believed that one of the reasons that the transducer provides such a good response both in terms of frequency spectrum and amplitude, is that the capacitor microphone arrangement 3 is sandwiched between a relatively rigid member (the base of the box 1) in contact with the vibrating surface of the musical instrument, and a relatively soft, flexible member (the plastic material 5). It is believed that the relatively rigid base of the box provides for an efficient transference of the vibrations of the instrument to the capacitor microphone arrangement 3, and that the relatively soft plastic material 5 allows the vibrations to produce a substantial relative movement of the electrodes 9, 10 over a wide frequency range and in particular over the entire fundamental frequency range of a piano. Moreover, the described transducer has the significant advantage that it substantially only detects the sound produced by the instrument to which it is attached and does not pick up sound from adjacent instruments. The described example of the transducer can be used with many instruments, particularly stringed instruments and also drums. However, the described transducer can be used with special advantage on a piano, and a preferred mounting arrangement of two such transducers is shown in FIG. 5, for obtaining a stereo sound picture for the piano, the transducers being mounted on the soundboard which underlies the piano. It has been found that, when the described example of the transducer is used on a piano, the transducer and the sensing circuit provide signals in response to the entire fundamental frequency range of the piano.

Another embodiment of transducer of the invention will now be described with reference to FIGS. 6 and 7. This embodiment includes the capacitor microphone arrangement 3 previously described, housed within a box 20 but attached to the lid 21 of the box, rather than to its base as in the previously described embodiment. The lid 21 of the box 20 is adapted to be attached in intimate contact with a vibrating surface of a musical instrument.

Within the box 20 is an elongate rectangular block of perspex 22, formed at one end with a recess 23 and a channel 24 which receive the cable 13 and its soldered connections to the capacitor microphone arrangement 3. The surface of the block 22 which faces the lid 21 is covered with a cellular adhesive strip 26, such as one of the strips sold under the trade names "Perfix" and "Cyamber" by Cyamber Tapes Ltd. of Shoreditch, London, E.1., England. The capacitor microphone arrangement 3 adheres to the strip 26, and the strip has a cut out portion 27 which allows the cable 13 and its soldered connections to sit in the recess and channel 23, 24.

The capacitor microphone arrangement 3 includes a double sided self adhesive strip 28 which holds the arrangement 3 in intimate contact with the lid 21. The cable 13 passes out of the box 20 through a hole 29. The box 20 is made by vacuum forming from 2 mm thick styrene, such as to have a peripheral flange 30 which is welded or glued to the lid 21. The lid itself is made of 1 mm thick polystyrene sheet and has dimensions $8\frac{1}{2}''$-$\times 1\frac{1}{2}''$. As can be seen from FIG. 6, a small air gap exists between the box 20 and the perspex block 22.

The exterior of the lid 21 is provided with a length of double sided self adhesive tape 31 which is used to attach the lid to a musical instrument. For a more permanent attachment, the transducer is provided with holes 32 in the peripheral flange 30 to allow the transducer to be held by screws on the instrument.

From the foregoing, it will be seen that the capacitor microphone arrangement 3 is sandwiched between the relatively rigid polythene material of the lid 21 which contacts the instrument, and the relatively flexible cellular material of the strip 26, and thus the two described embodiments both provide similar mountings for the capacitor microphone arrangement 3 on the instrument, even though the mounting thereof in the box differs somewhat for the two embodiments.

I claim:

1. An electro-acoustic transducer for providing electrical signals corresponding to sounds in a vibratory surface of a musical instrument, comprising
   (a) a relatively flexible body of plastic material;
   (b) a relatively rigid support member of plastic material for attachment to a musical instrument on a surface thereof which vibrates in accordance with sound produced by playing of the instrument; and
   (c) a capacitor microphone arrangement sandwiched between said support member and said body, said capacitor microphone arrangement comprising
      (i) a first electrode comprising an elongate foil of electrically conductive material;
      (ii) a second electrode comprising an elongate flat sheath of electrically conductive foil within which said first electrode is received; and
      (iii) a dielectric between said electrodes and electrically insulating said electrodes from one another.

2. An electro-acoustic transducer in accordance with claim 1, wherein said support member comprises a box open on one side and having an elongate base, and said microphone arrangement includes a double-sided self-adhesive tape which attaches said second electrode to said base, and said relatively flexible plastic material comprises a cold curing polyurethane compound substantially filling said box.

3. An electro-acoustic transducer in accordance with claim 2, wherein said box is made of high impact molded polystyrene.

4. An electro-acoustic transducer in accordance with claim 3, wherein the open side of the box is closed by a lid of plastic material attached to said cold curing compound by a double-sided self-adhesive tape.

5. An electro-acoustic transducer in accordance with claim 1, including a double-sided self-adhesive tape attached to said base of said box exteriorly thereof for attaching said box to a musical instrument.

6. An electro-acoustic transducer in accordance with claim 1, including a jack socket mounted on said box and having contacts electrically connected to said electrodes.

7. An electro-acoustic transducer in accordance with claim 1, wherein said support member comprises an elongate box having a lid, said microphone arrangement being mounted on said lid interiorly of said box, and said relatively flexible body of material comprises a strip of self adhesive plastic material overlying said microphone arrangement, and including a relatively rigid block of plastic material overlying and adhering to said strip.

8. An electro-acoustic transducer in accordance with claim 7, including a layer of double-sided self-adhesive tape attaching said microphone arrangement to said lid.

9. An electro-acoustic transducer in accordance with claim 7, wherein said lid comprises a polystyrene sheet, said strip comprises a cellular self-adhesive material, and said block is made of perspex.

10. An electro-acoustic transducer in accordance with claim 7, wherein said box includes a peripheral flange attached to the periphery of said lid.

11. An electro-acoustic transducer in accordance with claim 1, wherein said dielectric comprises a self adhesive tape attached to said first electrode.

12. An electro-acoustic transducer in accordance with claim 1, including a sensing circuit connected to said electrodes, said circuit including means for applying a substantially constant potential difference to said electrodes, and means for amplifying oscillatory voltages established between said electrodes.

13. The combination of a musical instrument, an electro-acoustic transducer for providing electrical signals corresponding to sounds in a vibratory surface of said instrument, said transducer being attached to said instrument on a surface thereof which vibrates in accordance with sound produced by playing of the instrument, said transducer comprising (a) a capacitor microphone arrangment comprising
  (i) a first electrode comprising an elongate foil of electrically conductive material;
  (ii) a second electrode comprising an elongate foil of electrically conductive material overlying said first electrode; and
  (iii) a dielectric between said electrodes and electrically insulating them from one another;
(b) a housing of plastic material in which said microphone arrangement is received, said housing being mounted in intimate contact with said surface of said instrument, and adapted to transmit vibrations thereof to said capacitor microphone arrangement so as to produce relative movement of said electrodes in accordance with said vibrations; and
(c) a sensing circuit connected to said electrodes, said circuit comprising means for applying a substantially constant potential difference to said electrodes, and means for amplifying oscillatory voltages established between said electrodes by said vibrations.

14. The combination according to claim 13, wherein said housing comprises an elongate box having a lid, the capacitor microphone arrangement being received within and in intimate contact with a surface of said box, said box being substantially filled with a plastic material which is relatively flexible compared with the material from which the box is made.

15. The combination according to claim 13, wherein said second electrode comprises a sheath of said foil within which said first electrode is received.

16. The combination according to claim 13, wherein said housing includes an elongate box having a lid, said capacitor microphone arrangement being mounted on said lid, and including a layer of self adhesive material more flexible than said lid and overlying said capacitor microphone arrangement, and a block of rigid plastic material overlying said self-adhesive material.

17. The combination according to claim 13, wherein said sensing circuit includes a battery for applying said constant potential difference to said electrodes, an operational amplifier powered by said battery and arranged to amplify the oscillatory voltages established between said electrodes.

18. The combination according to claim 17, wherein said sensing circuit includes an input for receiving a source of direct current external to said circuit, and switching means arranged to select electric power for said circuit either from said external source or from said battery.

19. The combination according to claim 18, including a transformer having a primary winding connected to receive amplified signals from said amplifier, and a secondary winding connected to an output of the device.

20. The combination according to claim 18, including testing means for providing a visual indication that said constant potential difference has been applied to said electrodes.

* * * * *